US005214625A

United States Patent [19]

Suzuki et al.

[11] Patent Number: 5,214,625

[45] Date of Patent: May 25, 1993

[54] SETTING MECHANISM FOR AN ANALOG TIMEPIECE

[75] Inventors: Hiroshi Suzuki; Shigeru Aoki; Akihiko Maruyama; Nobuhiro Koike, all of Suwa, Japan

[73] Assignee: Seiko Epson Corporation, Tokyo, Japan

[21] Appl. No.: 908,623

[22] Filed: Jun. 29, 1992

Related U.S. Application Data

[63] Continuation of Ser. No. 540,067, Jun. 19, 1990, abandoned.

[30] Foreign Application Priority Data

Jun. 19, 1989 [JP] Japan ..... 1-156436

[51] Int. Cl.[5] ..... G04B 27/04

[52] U.S. Cl. ..... 368/192; 268/190; 268/191; 268/185; 268/193

[58] Field of Search ..... 368/185, 190–199, 368/319–321, 308

[56] References Cited

U.S. PATENT DOCUMENTS

| | | | |
|---|---|---|---|
| 2,412,493 | 12/1946 | Carlstrom . | |
| 3,735,583 | 5/1973 | Bachmann . | |
| 4,555,185 | 11/1985 | Vuilleumier | 368/319 |
| 4,845,693 | 8/1989 | Kubota | 368/320 |
| 4,853,909 | 8/1989 | Shoji et al. | 368/319 |
| 4,910,721 | 3/1990 | Hayakawa et al. . | |
| 4,956,830 | 9/1990 | Mock et al. | 368/319 |
| 4,970,709 | 11/1990 | Kroner | 368/319 |

*Primary Examiner*—Bernard Roskoski
*Attorney, Agent, or Firm*—Blum Kaplan

[57] ABSTRACT

A multifunction analog timepiece including a stem responsive to external regulation for controlling a displayed function. The stem is positionable at at least two steps. A clutch wheel is disposed on and movable along the stem. A setting element coupled to the stem is operable for direct contact with the clutch wheel. The setting element is in direct contact with the clutch wheel and only one of the steps of the stem.

19 Claims, 8 Drawing Sheets

FIG. 4(a)
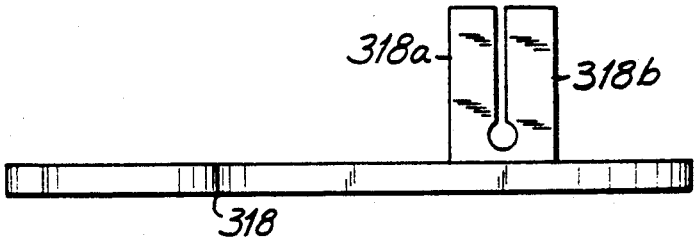
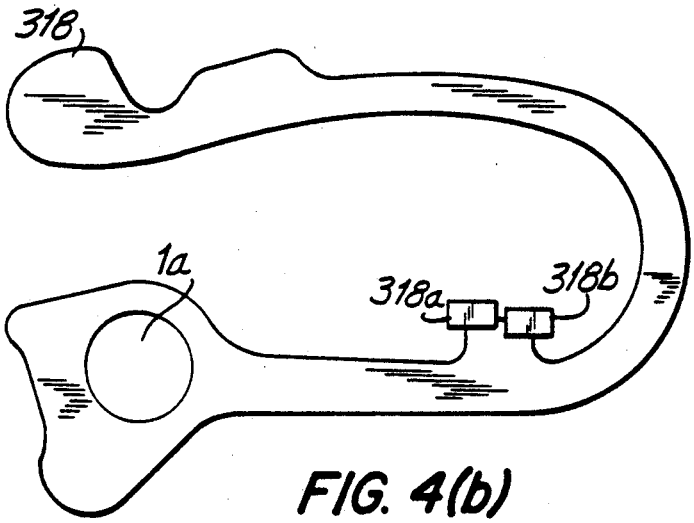
FIG. 4(b)
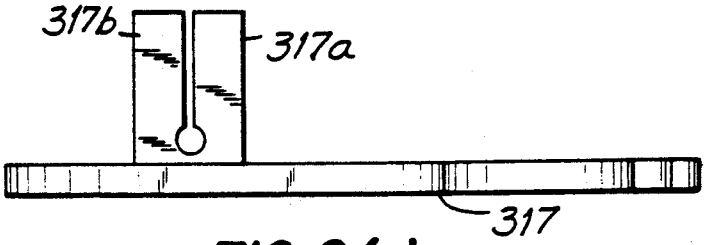
FIG. 9(a)
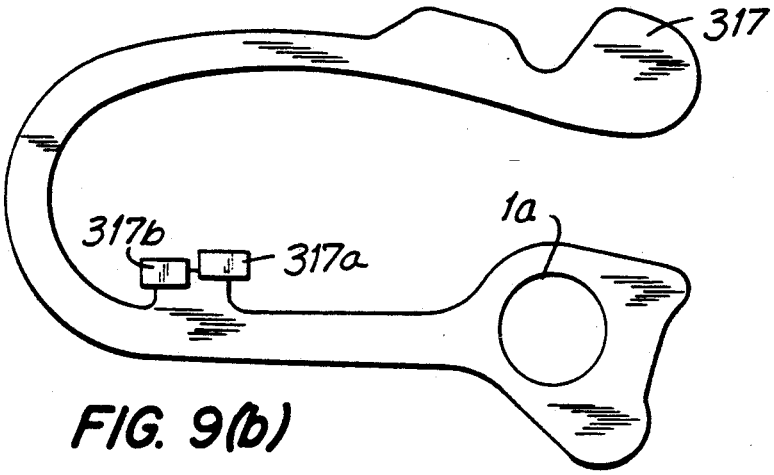
FIG. 9(b)

SETTING MECHANISM FOR AN ANALOG TIMEPIECE

This is a continuation of application Ser. No. 07/540,067, filed Jun. 19, 1990 now abandoned.

BACKGROUND OF THE INVENTION

This invention relates to an analog timepiece, and more particularly to both the interlocking arrangement between a setting element and a multipositional stem and the linkage arrangement between the setting element, a clutch wheel and gear train in a analog timepiece.

In correcting the time of a conventional analog timepiece a stem of the timepiece is pulled out. A setting lever associated with the pulled-out stem causes a corresponding yoke to push against a clutch wheel which engages a gear train. Rotation of the pushed out stem results in rotation of the gear train for correction of the displayed time of day. Two setting elements (i.e., the setting lever and yoke) are therefore required for the clutch wheel to travel in a direction opposite to the pushed out stem and to engage the gear train. The setting elements also require a relatively large area within the timepiece to permit the stem to be properly coupled through the setting lever and yoke to the gear train.

To meet present consumer demands associated with dress-type analog timepieces, the timepiece is designed to be relatively small in size and have a relatively thin body. The setting lever and yoke of the setting structure required for each displayed function impose limitations in the degree of miniaturization and thinness of the timepiece which can be achieved.

Conventional analog multifunction timepieces, which presently enjoy a relatively large share of the market, require a plurality of setting structures and/or a number of different elements within the same setting structure. Design of a relatively small, thin analog multifunction timepiece is therefore difficult to achieve.

It is therefore desirable to provide an analog multifunction timepiece having a relatively simple setting structure with less moving parts than a conventional multifunction analog timepiece. The timepiece also should be relatively small and have a relatively thin body.

SUMMARY OF THE INVENTION

Generally speaking, in accordance with the invention, an analog timepiece includes a setting structure which requires less moving parts to engage a clutch wheel to and disengage a clutch wheel from a gear train and thereby avoids the foregoing drawbacks associated with a conventional analog timepiece. The timepiece includes a stem (i.e., operating mechanism) responsive to external regulation for controlling a displayed function. The operating mechanism is positionable at at least two steps. A clutch wheel is disposed on and movable along the stem. The timepiece also includes a setting element which is connected to the stem and is operable for direct contact with the clutch wheel. The setting element is preferably a setting lever interlocked with the stem.

By providing a setting element which is operable for direct contact with the clutch wheel, the yoke which is required in a conventional timepiece need not be included as part of the setting mechanism. A reduction in the number of moving parts required within the timepiece results. The setting mechanism can be miniaturized resulting in a reduction in the size of the multifunction analog timepiece.

The timepiece also includes a gear train for engaging the clutch wheel. A spring device disengages the clutch wheel from the gear train when the setting element is separated from the clutch wheel.

The stem is movable in linear reciprocating directions to three different steps (i.e. positions). The setting element directly contacts the clutch wheel when the stem protrudes furthest from the timepiece.

Accordingly, it is an object of the invention to provide an improved multifunction analog timepiece which has a simplified setting structure compared to a conventional multifunction analog timepiece.

It is another object of the invention to provide an improved multifunction analog timepiece which has a setting structure with less moving parts and is smaller in size than a conventional multifunction analog timepiece.

Still other objects and advantages of the invention will, in part, be obvious and will, in part, be apparent from the specification.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3(*b*) is an elevational view of the switching structure of FIG. 3(*a*);

FIG. 4(*a*) is an elevational view of the switch of the switching structure of FIG. 3(*a*);

FIG. 4(*b*) is a plan view of the switch of FIG. 4(*a*);

FIG. 9(*a*) is a elevational view of another switch; and

FIG. 9(*b*) is a plan view of the switch of FIG. 9(*a*).

DESCRIPTION OF THE PREFERRED EMBODIMENTS

Figure 1:
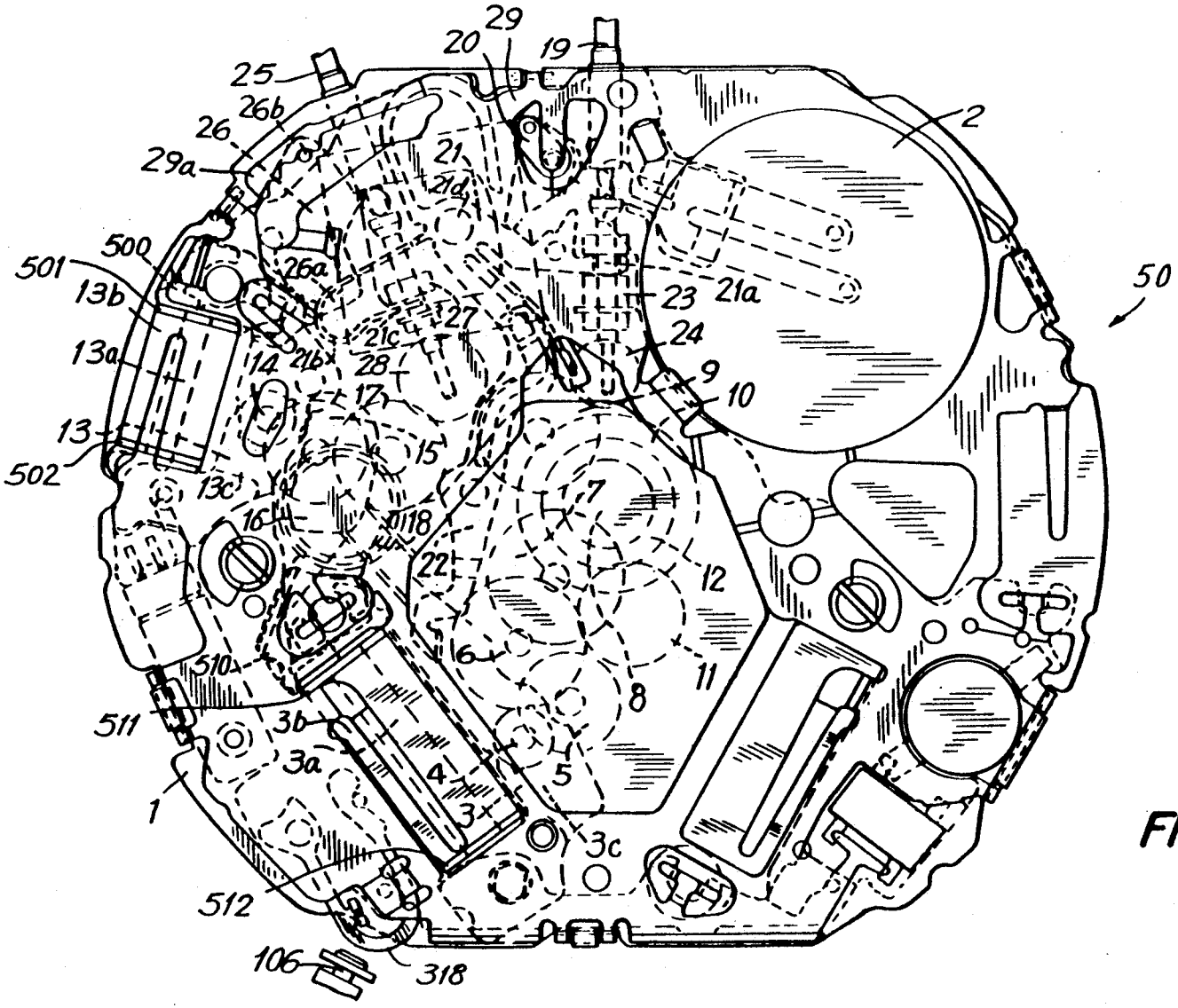
FIG. 1 is a plan view of a multifunction analog electronic timepiece in accordance with one embodiment of the invention.

FIG. 1 shows a timepiece movement 50 for a multifunction electronic watch which includes a time of day display and an alarm time display having a pair of step motors and a pair of switching members associated with a switching structure for adjusting the alarm time. The invention is particularly directed to the switching structure for adjusting the alarm time.

Timepiece movement 50 includes a base plate 1 formed of molded resin and a battery 2. A step motor 3 drives the standard time of day display. Step motor 3 includes a magnetic core 3a formed of a highly magnetic material and a coil block 3b which encloses a coil wound around magnetic core 3a. Coil block 3b also encloses a coil lead substrate 500 which has both ends thereof treated for electrical conduction. A coil frame 501, 502 is also enclosed by coil block 3b. Step motor 3 further includes a stator 3c formed of a highly magnetic material and a magnetic rotor 4.

Timepiece 50 also includes a fifth wheel 5, a fourth wheel 6, a third wheel 7 and a second wheel (minute needle assembly wheel) 8. Operation of fifth wheel 5, fourth wheel 6, third wheel 7 and second wheel 8 is well known in the art and is, for example, disclosed in U.S Pat. No. 4,910,721, which is incorporated herein by reference thereto.

A minute wheel 9 is coupled to second wheel 8. An hour wheel (hour needle assembling wheel) 10 is positioned along the same rotational axis as second wheel 8. A center second intermediate wheel 11 having no reduction ratio transmits movement of fourth wheel 6 to a seventh wheel (second needle assembling wheel) 12. A normal hour hand 105, minute hand 104 and second hand 103 can be displayed in the center of timepiece 50 based on the foregoing construction as shown in FIG. 2.

A step motor 13 drives the alarm setting time display. Step motor 13 includes a magnetic core 13a formed of highly magnetic material and a coil block 13b which encloses a coil wound around magnetic coil 13a and a coil lead substrate 510 and a coil frame 511, 512. The coil lead substrate has both ends treated for electrical conduction. Step motor 13 also includes a stator 13c formed from a highly magnetic material and a magnetic rotor 14.

Timepiece 50 further includes an alarm gear train of an alarm intermediate wheel 15, a center wheel (alarm minute needle assembling wheel) 16, a minute wheel 17 and an alarm hour wheel (alarm hour needle assembling wheel) 18. Alarm center wheel 16 and alarm hour wheel 18 are arranged on an axis having a direction passing through the region of the six o'clock display of timepiece 50. Accordingly, the alarm setting time can be displayed on an axis having a direction passing through the six o'clock display of watch 50.

Figure 2:
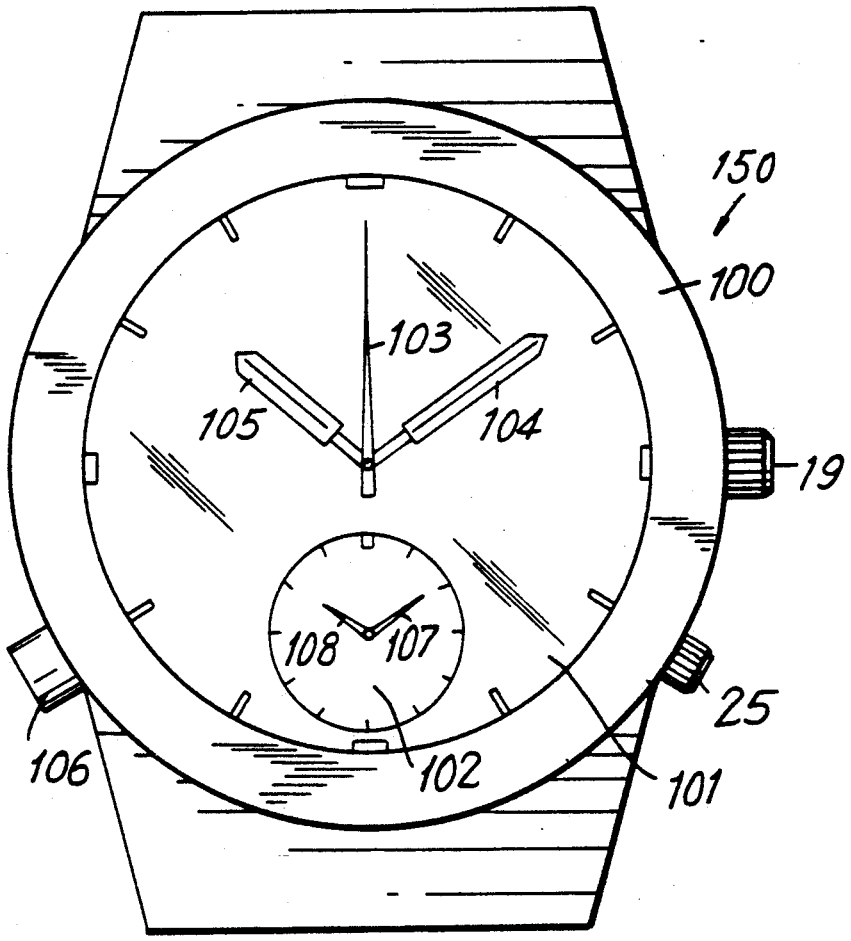
FIG. 2 is a plan view of the face of a multifunction analog watch including the electronic timepiece of FIG. 1.

As shown in FIG. 2, a timepiece 150 has timepiece movement 50 mounted in a casing 100 having a nameplate or dial 101. Nameplate 101 includes an alarm setting time display portion 102. The normal time of day is displayed by second hand 103, minute hand 104 and hour needle hand 105. Correction of the time of day is achieved by pulling out a first stem 19 until reaching the second of two steps. Once first stem 19 has been pulled out to its second step, fourth wheel 6 is standardized by a standardizing lever 22 engaging a mandarin 20 and a yoke 21 shown in FIG. 1. Consequently, movement of second hand 103 is halted. A bar 21a of yoke 21 pushes out a clutch wheel 23 which engages a setting wheel 24. Rotation of first stem 19 is transmitted to minute wheel 9 through a clutch wheel 23 and setting wheel 24.

Second wheel 8 has a constant slipping torque. Setting wheel 24, minute wheel 9, second wheel (minute needle assembling wheel) 8 and hour wheel 10 can be rotated when fourth wheel 6 is standardized. Minute hand 104 and hour hand 105 can therefore be rotated so as to permit the desired time of day to be set.

The switching structure for adjusting the alarm time display in accordance with the invention is as follows. The alarm setting time is displayed at display portion 102 of nameplate 101 and includes an analog time display of an alarm minute hand 107 and an alarm hour hand 108. When a second stem 25 is positioned at the first of its two adjusting positions and a switch button 106 is pushed in (i.e. depressed), alarm minute hand 107 and alarm hour hand 108 are advanced in one minute increments. The alarm time covers a 12 hour period. When switch button 106 is continuously depressed and second stem 25 is in its first adjusting position, alarm minute hand 107 and alarm hour hand 108 are continuously advanced with increasing acceleration. Setting of the alarm time is completed within a relatively short period of time. When the alarm time is set to correspond to the time of day, an alarm sound will be generated.

When second stem 25 is not pushed out (i.e., at its zero position or step), the alarm function is in a non-operational mode. In this mode, alarm minute hand 107 and alarm hour hand 108 advance as a typical minute hand and hour hand, respectively, and display the time of day. The time of day displayed by alarm minute hand 107 and hour hand 108 can be set to correspond to the time of day displayed by minute hand 104 and hour hand 105 or another desired time of day (e.g., corresponding to the time of day in another part of the world).

Figure 5:
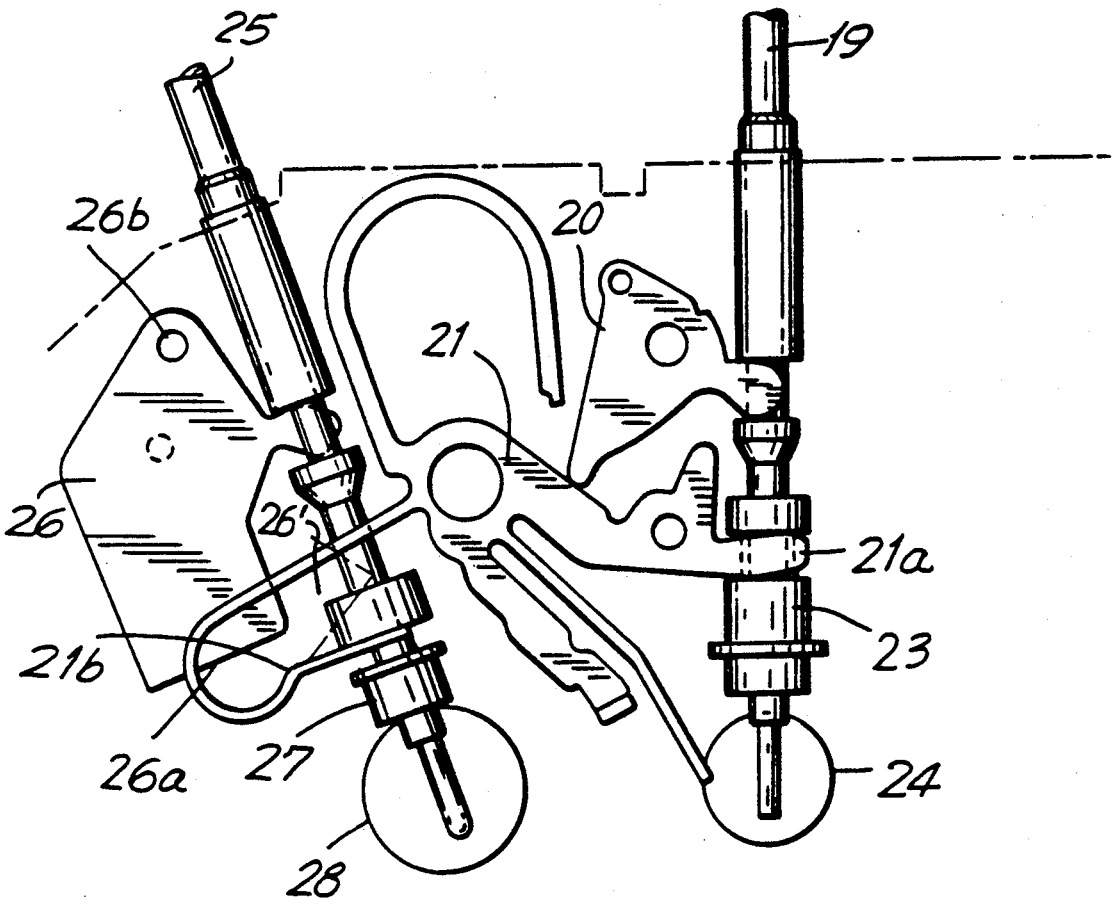
FIG. 5 is a fragmentary plan view of the multifunction analog electronic timepiece of FIG. 1 showing the position of the alarm setting lever with the second stem pulled out to its second position.

To correct the time of day displayed by alarm minute hand 107 and alarm hour hand 108, second stem 25 is positioned at the second of its two adjusting positions or steps as shown in FIG. 5. An alarm clutch wheel 27 is now pushed by a portion 26a of an alarm setting lever 26 resulting in alarm clutch wheel 27 engaging alarm setting wheel 28. The position of alarm setting lever 26 with second stem 25 pulled out to its second position is represented by an alarm setting lever 26' shown in FIG. 5 as dashed lines. Consequently, rotation of second stem 25 in its second adjusting position results in rotation of alarm date back wheel 17 through alarm clutch wheel 27 and alarm setting wheel 28. Rotation of second stem 25 is therefore transmitted to and controls the position of alarm hour hand 108 for correction of the time of day displayed by display portion 102.

Since alarm setting lever 26 is connected to second stem 25, once second stem 25 is returned to its first or zero step position, alarm setting lever portion 26a is separated from alarm clutch wheel 27. With second stem 25 in its first or zero step position alarm clutch wheel 27 is returned to its initial position shown in FIG. 1 by the spring force of a yoke spring 21b. A distal end 21c of yoke spring 21b is lockingly positioned adjacent to alarm clutch wheel 27. Accordingly, when portion 26a of alarm setting lever 26 pushes alarm clutch wheel 27 toward engagement with alarm setting wheel 28, yoke spring 21b is also pushed towards alarm setting wheel 28. Yoke 21 pivots about a pivot 21d resulting in bar 21a of yoke 21 pushing first stem 19 outwardly and thereby operating on clutch wheel 23. In other words, alarm setting lever 26 is coupled to both alarm clutch wheel 27 (through direct contact of portion 26a) and clutch wheel 23 (through indirect contact with yoke 21) for positioning both clutch wheels.

When second stem 25 is positioned at its second step for time correction, the previous alarm setting will be cancelled and the time of day indicated by alarm minute hand 107 and alarm hour hand 108 becomes the new alarm setting time when second stem 25 is returned its zero step. When a new alarm setting time is desired, second stem 25 is positioned after having been returned to its zero step to its first step and switch button 106 is pushed in. Alarm minute hand 107 and alarm hour hand 108 are advanced as discussed above to the desired new alarm setting time. When second stem 25 is positioned at its first step, alarm setting lever 26 is positioned by a spring 29*a* of a circuit hold plate 29. Alarm setting lever 26 includes a dowel 26*b* of setting lever portion 26*a*. Accordingly, spring 29*a* positions alarm setting lever 26 through contact with dowel 26*b* of setting lever portion 26*a*. The click force of alarm setting lever 26 through engagement of dowel 26*b* with spring 29*a* is generated by moving second stem 25 to its first step.

In this preferred embodiment of the invention, a returning spring force of yoke spring 21*b* is applied to alarm setting lever 26. It is to be understood, however, that other suitable structures for producing a returning spring force or the like applied to alarm setting lever 26 can be employed.

As explained below, in accordance with the preferred embodiment of the invention, a pair of switches are used in a multifunction analog electronic timepiece. It is to be understood, however, that a single switching construction also can be used in accordance with the invention for obtaining a relatively thin timepiece of relatively small size which includes a base plate made from a polymeric or other suitable insulating material.

Figure 3A:
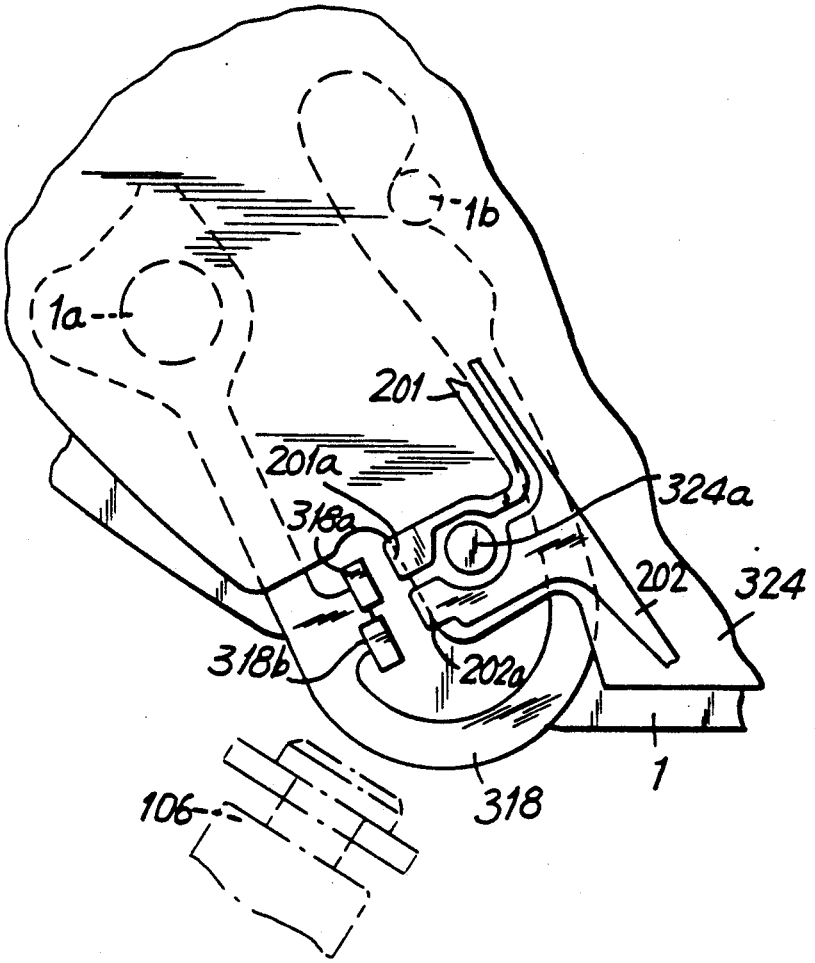
FIG. 3(*a*) is a fragmentary, plan view of a switching structure in accordance with the invention.
Figure 3B:
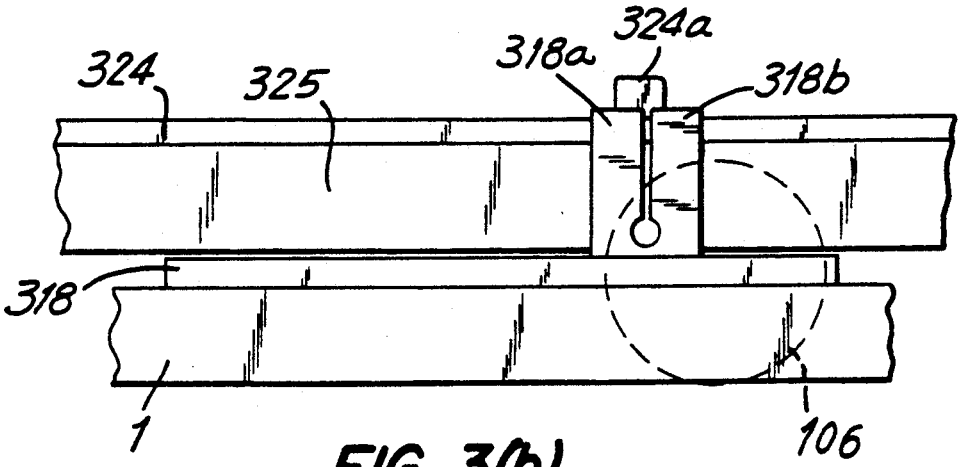

Referring now to FIG. 3, a C switch 318 in the shape of the letters "C" or "U" is guided by dowels or pins 1*a* and 1*b* rising from base plate 1 formed of a molded resin. A circuit receiver 325, which is also formed of a molded resin, is disposed on the upper side of C switch 318 and under a circuit block 324. A gap or space between C switch 318 and circuit receiver 325 is provided to permit C switch 318 to move freely underneath circuit receiver 325 without contacting circuit receiver 325. Circuit block 324 is guided and positioned by a dimple 324*a* extending therefrom.

A pair of copper leaf patterns 201 and 202 having contacting overhang portions 201*a* and 202*a*, respectively, are positioned above the upper side of C switch 318 and extend toward the plane of switch 318. Overhang portions 201*a* and 202*a* are disposed about dimple 324*a*. Copper leaf pattern 201 is electrically coupled to the positive (+) potential of battery 2. Copper leaf pattern 202 is electrically coupled to circuit block 324. Base plate 1 supports directly or indirectly leaf patterns 201 and 202 and circuit block 324.

C switch 318 includes a pair of conductive bent portions 318*a* and 318*b* which are adjacent but not aligned with each other and project upwardly from the plane of switch 318. Bent portions 318*a* and 318*b* extend at approximately 90° from the upper side of C switch 318 for cooperating with overhang portions 201*a* and 202*a*. When a switch button 106 is pushed towards base plate 1, bent portion 318*a* of C switch 318, which is normally biased away from overhang portion 201*a* overhang portion 201*a* which is electrically coupled to the positive (+) potential of battery 2. C switch 318 is now at the positive (+) potential of battery 2. When switch button 106 is further pushed towards base plate 1, bent portion 318*b* contacts overhang portion 202*a* of copper leaf pattern 202 which is electrically coupled to circuit block 324. Accordingly, the voltage of battery 2 is applied to the integrated circuit (e.g. CMOS-IC) of circuit block 324. Setting of the alarm time can now be carried out. The construction C switch 318 is shown in FIGS. 4(*a*) and 4(*b*). By adjusting the position of C switch 318 through engagement or non-engagement with switch button 106, operation of the chronographic function can be initiated or halted.

In accordance with an alternative embodiment of the invention, a timepiece movement 50' for a multifunction electronic watch 150' includes time of day, alarm and chronographic functions. Those elements of timepiece 150 which are similar in construction and operation to elements of timepiece 150' have been identified by like reference numerals.

Figure 6:
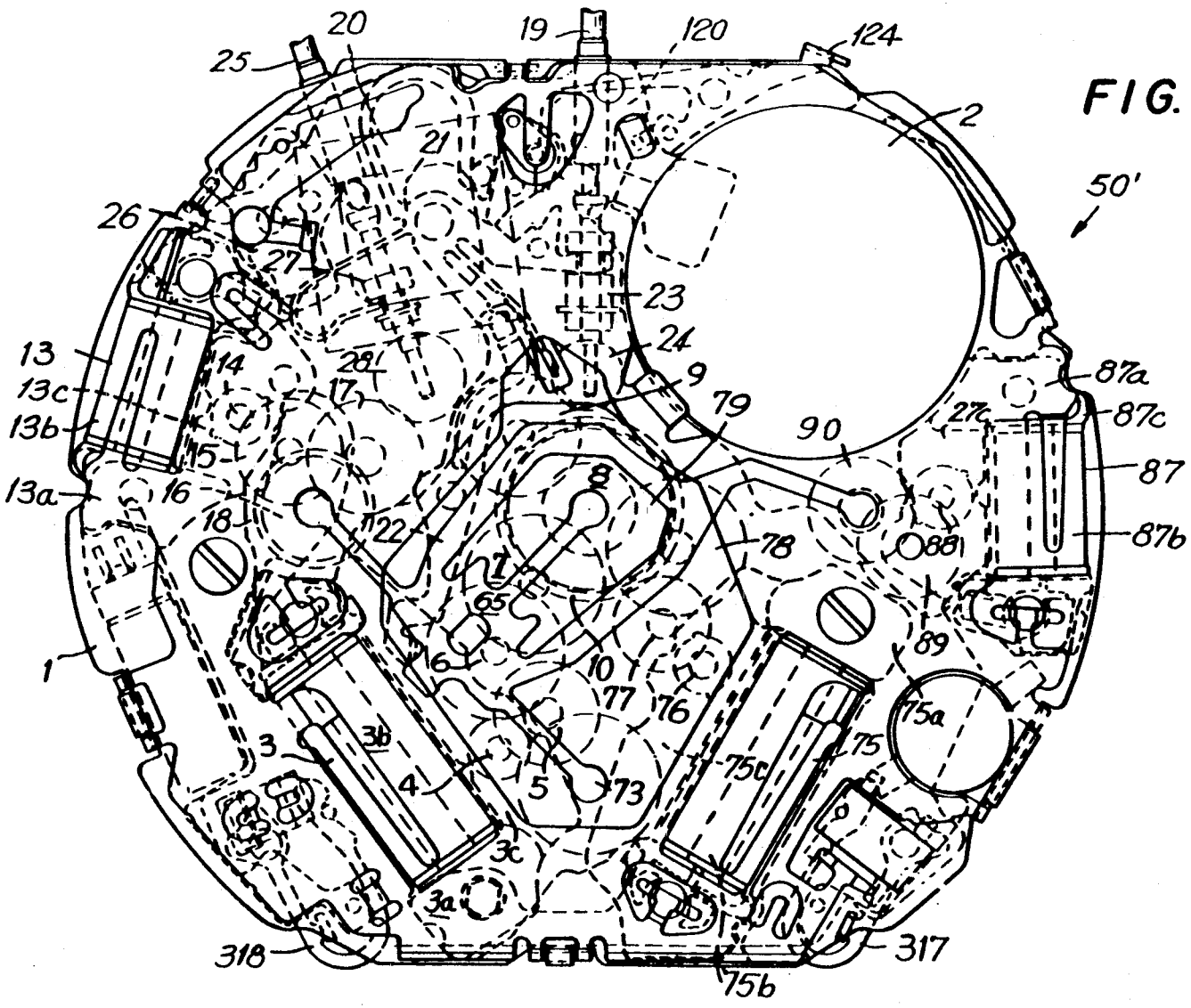
FIG. 6 is a plan view of a multifunction analog electronic timepiece in accordance with an alternative embodiment of the invention.
Figure 7:
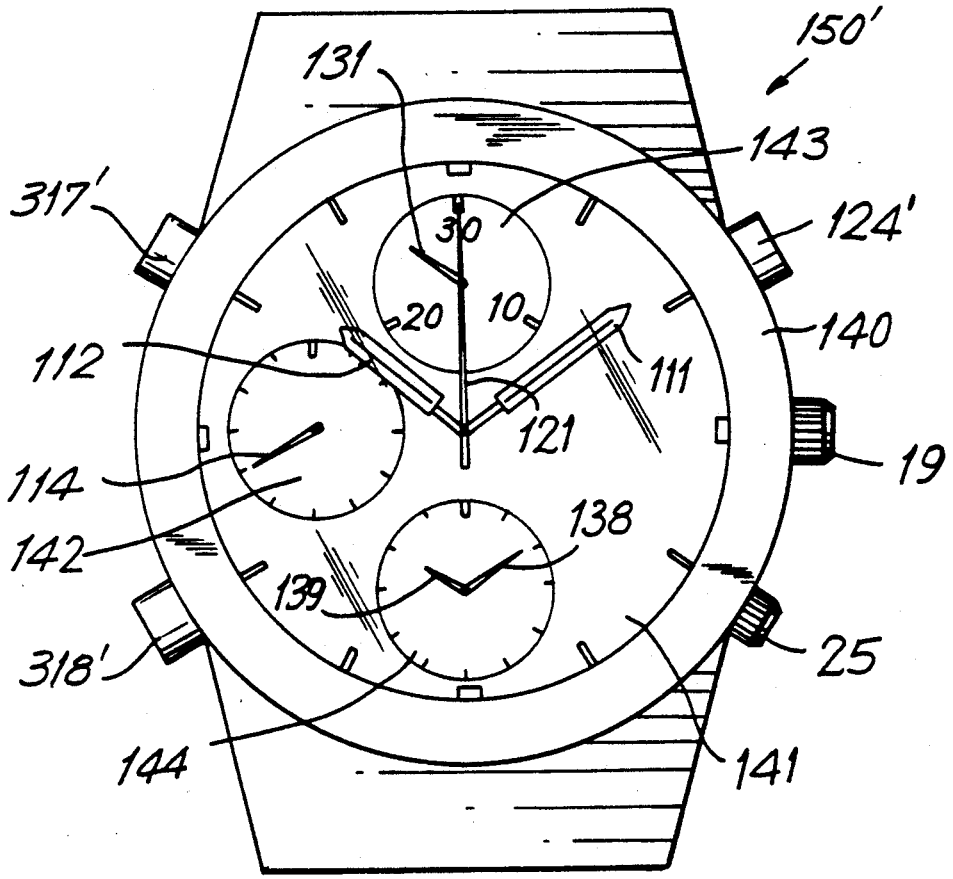
FIG. 7 is a plan view of the face of a multifunction analog watch including the electronic timepiece of FIG. 6.

Referring to FIG. 7, timepiece 150' has timepiece movement 50' mounted in a casing 140 having a nameplate or dial 141 showing the time of day to display the various functions. Dial 141 includes an alarm set dial 144, a seconds dial 142 and a chronographic dial 143. The normal time of day is displayed by a minute hand 111, an hour hand 112 and a second hand 114. A chronograph second hand 121 and a chronograph minute hand 131 rotate about the centers of dials 141 and 143, respectively. The alarm function is indicated by an alarm minute hand 138 and an alarm hour hand 139. A button 124', a button 317' and a button 318' correspond to a switch 124, a B switch 317 and a C switch 318 (shown in FIG. 6), respectively.

As shown in FIG. 6, timepiece movement 50' includes a step motor 3, a step motor 13, a step motor 75 and a step motor 87. Step motor 3 drives the standard time of day display. Step motor 13 drives the alarm time display. Timepiece movement 50' is similar to timepiece movement 50 of FIG. 1 except for the addition of step motors 75 and 87 and related elements associated with the chronographic function and certain elements associated with seconds for the time of day.

Step motor 75 drives chronograph second hand 121 and includes a magnetic core 75*a* formed from a highly permeable material, a coil block 75*b*, a stator 75*c* and a rotor 76. Coil block 75*b* includes a coil wound on magnetic core 75*a*, a coil lead substrate which has both ends thereof treated for electrical conduction and a coil frame Stator 75*c* is made from a highly permeable material. Rotor 76 includes a rotor magnet and a rotor pinion. The rotational energy of rotor 76 is coupled to chronograph second hand 121 through a chronograph first intermediate wheel 77, a chronograph second intermediate wheel 78 and a chronograph wheel 79. Chronograph wheel 79 is positioned at the center of timepiece 150'. The reduction gear ratio between rotor 76 and chronograph wheel 79 is 1/150. Rotor 76 rotates 2½ times or 900 degrees per second based on electrical signals supplied from a CMOS-IC 120. Accordingly, chronograph wheel 79 rotates 6 degrees per second resulting in the display of 60 seconds of elapsed time per revolution.

Step motor 87 drives chronograph minute hand 131 and includes a magnetic core 87*a* formed from a highly permeable material, a coil block 87*b*, a stator 87*c* and a rotor 88. Coil block 87*b* includes wound on magnetic core 75*a*, a coil lead substrate having both ends treated for electrical conduction and a coil frame. Stator 87*c* is made from a highly permeable material. Rotor 88 includes a rotor magnet and a rotor pinion. The rotational energy of rotor 88 engages chronograph minute hand 131 through chronograph intermediate wheel 89 and chronograph minute wheel 90.

Chronograph minute wheel 90 is positioned to rotate on an axis eccentric to the center of dial 141. The axis of chronograph minute wheel 90 passes through the region of the twelve o'clock display of timepiece 150'. The reduction gear ratio between rotor 88 and chronograph minute wheel 90 is 1/30. Rotor 88 rotates once per minute on electrical signals from CMOS-IC 120 resulting in an elapsed time of 30 minutes. By combining the displays of chronograph hands 121 and 131, a chronograph display ranging between a minimum of 1/5 seconds to a maximum of 30 minutes is provided.

A second wheel 73 engages fifth wheel 5 for turning second hand 114 on dial 142 to display the number of seconds associated with the standard time of day. A spring 65 presses the axes about which second wheel 73, chronograph wheel 79, chronograph minute wheel 90 and alarm minute wheel 16 rotate to prevent the same from swinging about and thereby maintaining the proper position of each relative to each other.

Switch 124 controls the starting and stopping of the chronograph function. B switch 317 is used for splitting the chronographic function (i.e., restarting to continue the same chronographic period). C switch 318 is used for setting the alarm time display. The switching structure of B switch 317 is substantially the same as C switch 318.

Figure 8:
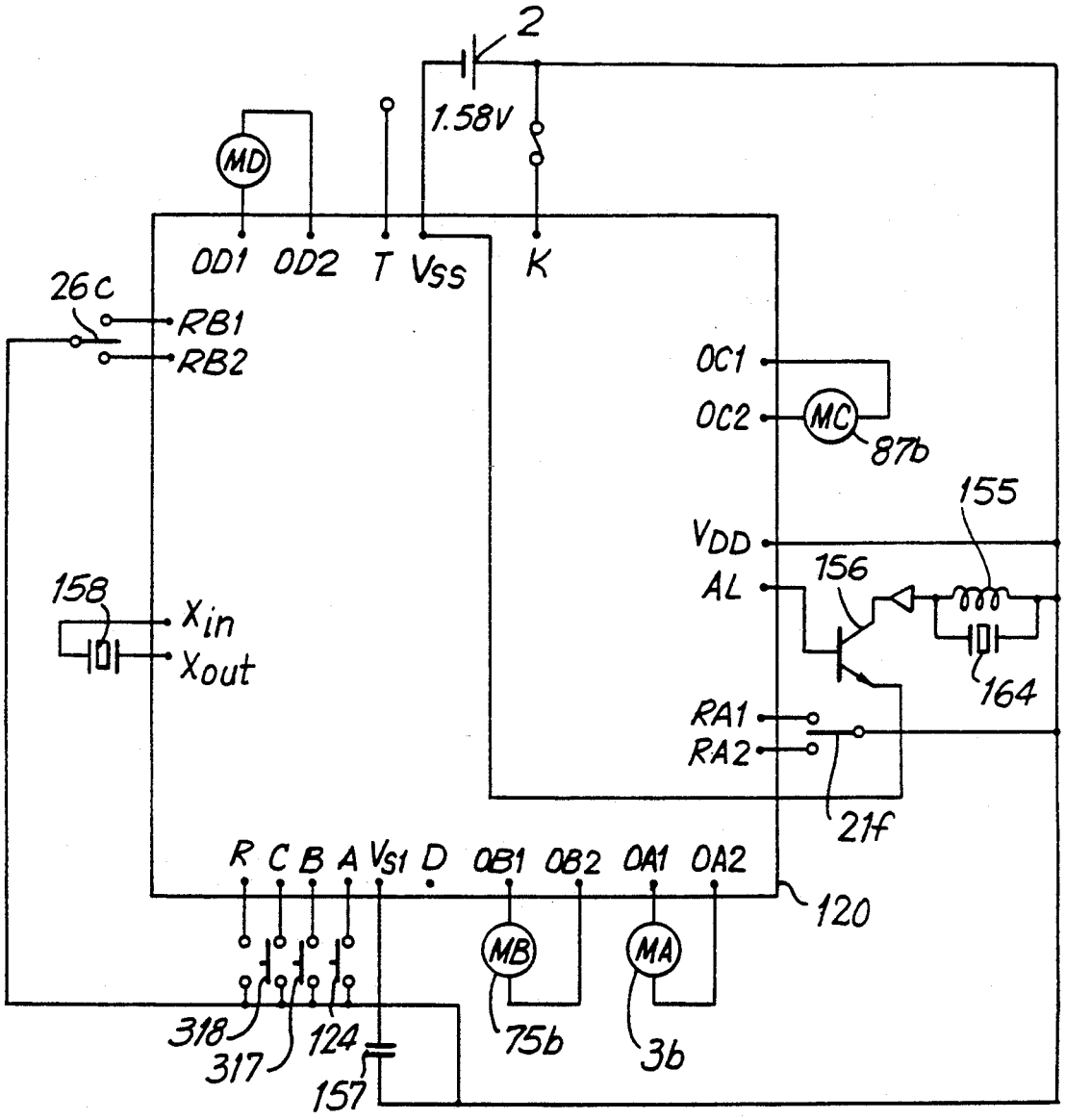
FIG. 8 is a circuit diagram of the multifunction analog electronic timepiece of FIG. 6.

The electrical connections between CMOS-IC 120 and the other electrical elements of timepiece movement 50' are shown in FIG. 8. A silver oxide battery 2 serves as the power source for CMOS-IC 120. The electrical circuitry of timepiece 50' also include a pair of buzzer driving elements 155 and 156, a boosting coil 155, a minimold transistor 156 with a protective diode, a 1 microfarad chip capacitor 157 for suppressing voltage fluctuations of a constant voltage circuit incorporated in CMOS-IC 120 and a microtuning fork type crystal oscillator 158. Oscillator 158 serves as the oscillation source of the oscillator circuit incorporated in CMOS-IC 120. Other electrical elements within timepiece movement 50' include a switch **21*f* formed on a portion of yoke 21, a switch 26*c* formed on a portion of alarm setting lever 26 and a piezoelectric buzzer 164 which is secured to the back cover of watch case 140**.

Switches 124, 317 and 318 are typically of a push-button type which can be closed only when fully pushed in. Switch **21*f* is interlocked with first stem 19 and contacts a RA1 terminal at the first position of first stem 19 and a RA2 terminal at the second position of first stem 19. Switch 21*f* with first stem at its zero position (i.e., not pulled out) is in a normally open position. Switch 26*c* is interlocked with second stem 25 and contacts a RB1 terminal when second stem 25 is at its first pulled out position and contacts a RB2 terminal when second stem 25 is at its second pulled out position. Switch 26*c* is normally in an open position when second stem 23** is at its zero (not pulled out) position.

Operation of switches 124, 317, 318, **21*f* and 26*c* in combination with each other provide the necessary electrical connections between CMOS-IC 120 and the other electrical elements of timepiece 150' to operate the various functions of the multifunction display. Switches 124 and 317 are required only when the chronographic function, driven by step motors 75 and 87, is desired. Accordingly, switches 124 and 317 are not included in the previous embodiment of the invention shown in FIG. 1**.

When switch **26*c*, which is interlocked with setting lever 26, is in its normally open position, CMOS-IC 120 supplies a driving signal every minute to step motor 87. When second stem 25 is pulled out to its first step position, switch 26*c* contacts RB1 terminal and CMOS-IC 120 supplies a high frequency driving pulse so that alarm minute hand 138 and alarm hour hand 139 display the previously set alarm time stored in the memory of CMOS-IC 120. When C switch 318 is pushed in, alarm minute hand 138 and alarm hour hand 139 can be set to a new alarm time which is stored in CMOS-IC 120. When the standard time of day displayed by minute hand 111 and hour hand 112 coincide with the alarm time displayed by alarm hour hand 139 and alarm minute hand 138, buzzer 164 operates. When second stem 25 is pulled out to its second position, switch 26*c* contacts RB2 terminal and the ordinary time counter and alarm setting counter in CMOS-IC 120** are reset.

By pushing in switch 124, the chronograph function is initiated and CMOS-IC 120 produces a driving signal supplied to step motors 75 and 87. When switch 124 is next pushed in, movement of chronograph second hand 121 and chronograph minute hand 131 is halted. By then pushing in B switch 317, hand 121 and 131 return to their initial position. When B switch 317 is pushed in, the driving signals for running the chronographic function are interrupted. When B switch 317 is once again pushed in, the driving signals are once again provided for running the chronographic function.

The construction of B switch 317, which is used to reset the chronographic function, is shown in FIGS. 9(*a*) and 9(*b*). B switch 317 and C switch 318 are made from electrically conductive materials and are formed by reversing the bending direction of the copper leaf pattern contacting portions. B switch 317 includes a pair of bent portions **317*a* and 317*b* which are similar in construction to bent portions 318*a* and 318*b* of C switch 318, respectively. B switch 317 and C switch 318** are otherwise similar in shape except for reverse bending directions.

As now can be readily appreciated, timepiece 150 includes both the standard time of day display and an alarm time display which are independent of one another. The alarm time display and standard time of day display are clearly separated from each other to avoid confusion and error by a user in setting the alarm time. The alarm display can be used to display both the desired alarm time and a desired time of day. The time of day displayed by alarm minute hand 107 and alarm hour hand 108 can be the same as or different than the time of day displayed by minute hand 104 and hour hand 105. Second stem 25 is used both for setting the alarm time and for changing the time of day displayed by alarm minute hand 107 and alarm hour hand 108.

Timepiece 150 can display the time of day in two different time zones based on a relatively simple construction using a base plate made from a polymeric or other insulating material which is relatively thin and small in size. Timepiece 150 can provide a display of two different time zones making it extremely convenient for journey aborad.

The alarm time and time of day displayed by alarm minute hand 107 and alarm hour hand 108 can be adjusted using switch button 106 and second stem 25. Adjustment of the alarm time and time of day displayed by alarm minute hand 107 and hour hand 108 is readily apparent to a user which substantially minimizes if not avoids confusion by a user as to the selected alarm time.

Since clutch wheel 23 is directly pushed out by the setting lever, a conventional yoke is not required. A switching arrangement providing a limited narrow space can therefore be achieved. In particular, in a multifunction timepiece such as a watch in which space within the watch is limited, it is especially effective to use a switching arrangement in accordance with the invention such that first stem 19 and second stem 25 approach one another at positions of approximately three and four o'clock.

Timepiece 150 provides two independent time displays each having their own switching arrangement for correcting their time of day. The alarm time display can be adjusted independent of (i.e., external to) adjustment of the time of day displayed by minute hand 104 and hour hand 105. The yoke is part of the switching member and can move both correction (i.e. clutch) wheels. In such a construction in which there is a limited amount of space a timepiece with two stems, such as first stem 19 and second stem 25, can approach one another at positions of three and four o'clock, respectively. Requiring that a separate yoke be arranged in each switching portion is undesirable since the timepiece must be redesigned to accommodate an increase number of elements therein. An increase in the cost of the timepiece results. The increased number of elements required within the timepiece also increases the amount of time required to manufacture the timepiece. Still further, when an increased number of elements is required servicing of the timepiece is complicated and increases the time for disassembly and assembly of the timepiece.

As also now can be readily appreciated, the switching construction including copper leaf pattern 202 on circuit block 324 applies a positive (+) potential of battery 2 to circuit block 324 without requiring formation of another conductive switching member. Timepiece 150 does not require that a positive (+) potential of battery 2 be provided along the periphery of the switching member. Accordingly, a remarkably simple switching structure can be realized. The simplified switching structure avoids difficulties present in conventional timepieces and associated with an additional switching member for providing the positive (+) potential of battery 2 to circuit block 24. Such additional switching is required when resin molded or other insulating materials are used for base plate 1.

The invention provides a multifunction analog electronic timepiece with less internal members than a conventional multifunction analog electronic watch and is therefore less complicated to manufacture, operate and service. The switching structure of a conventional multifunction analog electronic watch having a base plate made from a resin molded or other insulating material, as compared to timepiece 150, is much more difficult to assemble and disassemble, increases the cost of manufacture and decreases the reliability in providing a conductive path from the battery to the circuit block.

Conventional multifunction analog electronic watches require a plurality of a conductive portions from the battery to the circuit block to accommodate the various functions. A far larger internal area within the timepiece is required than is required by timepiece 150. Arrangement of copper leaf pattern 201 relative to the positive (+) potential of battery 2 is extremely simple to provide. An extremely high level of reliability associated with the switching structure of timepiece 150 is realized. Initially contacting the pattern conducting portion of the switching member with the positive (+) potential of battery 2 ensures that the switching member will, with an extremely high level of confidence, provide the positive (+) potential of battery 2 to circuit block 324. The switching structure, however, must ensure that the switching input pattern does not initially provide the positive (+) battery 2 to circuit block 324. Otherwise, the desired function will not operate when pushing the associated switch button. It is also extremely advantageous to provide bent portions for B switch 317 and C switch 318. More particularly, greater freedom in the design, less material working and reduce cost associated in B switch 317 and C 318 results.

It will thus be seen that the objects set forth above and those made apparent from the preceding description are efficiently attained and, since certain changes may be made in the above construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. In an analog timepiece, an analog function display setting device comprising:

analog means for displaying a function;

operating means responsive to external regulation for controlling the displayed function when longitudinally displaced to a predetermined position;

a clutch wheel disposed on and movable along said operating means to and away rom an operable position at which said clutch wheel is operably coupled to said analog means for controlling the displayed function in response to the external regulation of said operating means; and a setting element connected to said operating means and operable for moving said clutch wheel along said operating means to the operable position in response to the longitudinal displacement of said operating means by direct contact with said clutch wheel and for restricting further longitudinal displacement of said operating means when said clutch wheel is at its operable position and said operating means is at is predetermined position, said setting element consisting of a single rigid pivotable member.

2. The analog timepiece of claim 1, wherein said operating means can be moved to at least two positions and said setting element is in direct contact with said clutch wheel when the operating means is at one of these two positions.

3. The analog timepiece of claim 1, further including gear train means for engaging said clutch wheel.

4. The analog timepiece of claim wherein said setting element is a setting lever interlocked to said operating means.

5. The analog timepiece of claim 3, further including spring means for disengaging said clutch wheel from said gear train means when said setting element is separated from said clutch wheel.

6. The analog timepiece of claim 2, further including gear train means for engaging said clutch wheel.

7. The analog timepiece of claim 6, further including spring means for disengaging said clutch wheel from said gear train means when said setting element is separated from said clutch wheel.

8. The analog timepiece of claim 2, wherein said setting element is a setting lever interlocked to said operating means.

9. The analog timepiece of claim 8/ further including gear train means for engaging said clutch wheel.

10. The analog timepiece of claim 9, further including spring means for disengaging said clutch wheel from said gear train means when said setting element is separated from said clutch wheel.

11. The analog timepiece of claim 3, wherein said setting element is a setting lever interlocked to said operating means.

12. The analog timepiece of claim 5, wherein said setting element is a setting lever interlocked to said operating means.

13. The analog timepiece of claim 1, wherein said operating means is movable in linear reciprocating directions to three different positions.

14. The analog timepiece of claim 13, wherein said setting element is in direct contact with said clutch wheel at only one of said three positions.

15. The analog timepiece of claim 14, wherein said operating means protrudes furthest from said timepiece when at said one of said three positions.

16. The analog timepiece of claim 15, further including gear train means for engaging said clutch wheel.

17. The analog timepiece of claim 15, wherein said setting element is a setting lever interlocked to said operating means.

18. The analog timepiece of claim 16, further including spring means for disengaging said clutch wheel from said gear train means when said setting element is separated from said clutch wheel.

19. The analog timepiece of claim 16, wherein said setting element is a setting lever interlocked to said operating means.

* * * * *